United States Patent [19]

Marshall et al.

[11] Patent Number: 4,700,263

[45] Date of Patent: Oct. 13, 1987

[54] SAFE-ARM SYSTEM WITH ELECTRICAL CHARGE TRANSFER CIRCUIT

[75] Inventors: William F. Marshall, Belmont, Calif.; Richard Mabry, Ft. Walton Beach, Fla.

[73] Assignee: Quantic Industries, Inc., San Carlos, Calif.

[21] Appl. No.: 782,709

[22] Filed: Oct. 1, 1985

[51] Int. Cl.[4] ..... F23Q 7/00

[52] U.S. Cl. ..... 361/251; 102/206

[58] Field of Search ..... 361/251, 256, 257, 248; 102/206-208, 218, 220

[56] References Cited

U.S. PATENT DOCUMENTS 3,752,081 8/1973 McKeown et al. ..... 361/251

*Primary Examiner*—Michael L. Gellner
*Assistant Examiner*—David M. Gray
*Attorney, Agent, or Firm*—Flehr, Hohbach, Test, Albritton & Herbert

[57] ABSTRACT

A safe-arm system for an explosive munition is provided which is in the form of a charge transfer circuit, including a low-voltage capacitor bank which over a relatively long period of time is charged by an associated air turbine. After being charged up, this charge is transferred to a transinductance by a transinductance to convert the low voltage to a high voltage. By the use of a multiplicity of transfer steps, which occur over a very short period of time, the size and weight of the transinductance can be small.

5 Claims, 10 Drawing Figures

SAFE-ARM SYSTEM WITH ELECTRICAL CHARGE TRANSFER CIRCUIT

The present invention is directed to a safe-arm system with an electrical charge transfer circuit and more specifically to a system focus with an explosive munition. The present invention was developed under Air Force Contract No. FO-8635-84-C-0263.

In bombs and missle systems, it is desired that the munition not be armed until it is at a safe distance from, for example, the airplane or from the drop point or launch area, and that the safe-arming function be done with good efficiency, reliability and with a circuit and mechanism that occupies a small volume and is light weight.

Thus, it is an object of the invention to provide an improved safe-arm system.

In accordance with the above object, there is provided a safe-arm system for an explosive munition comprising a low-level power source which is incapable of directly initiating detonation of such munition. First energy storage means are connected to the power source and responsive thereto for storing energy over a period of time. Second energy storage means are provided which are capable of initiating the detonation of the munition. Means for transferring energy from the first to the second storage means is provided, the transferring occurring in response to a command occurring after such period of time for the first energy storage means to store energy. Finally, there are means for providing such command.

DETAILED DESCRIPTION OF THE PREFERRED EMBODIMENT

Figure 1:
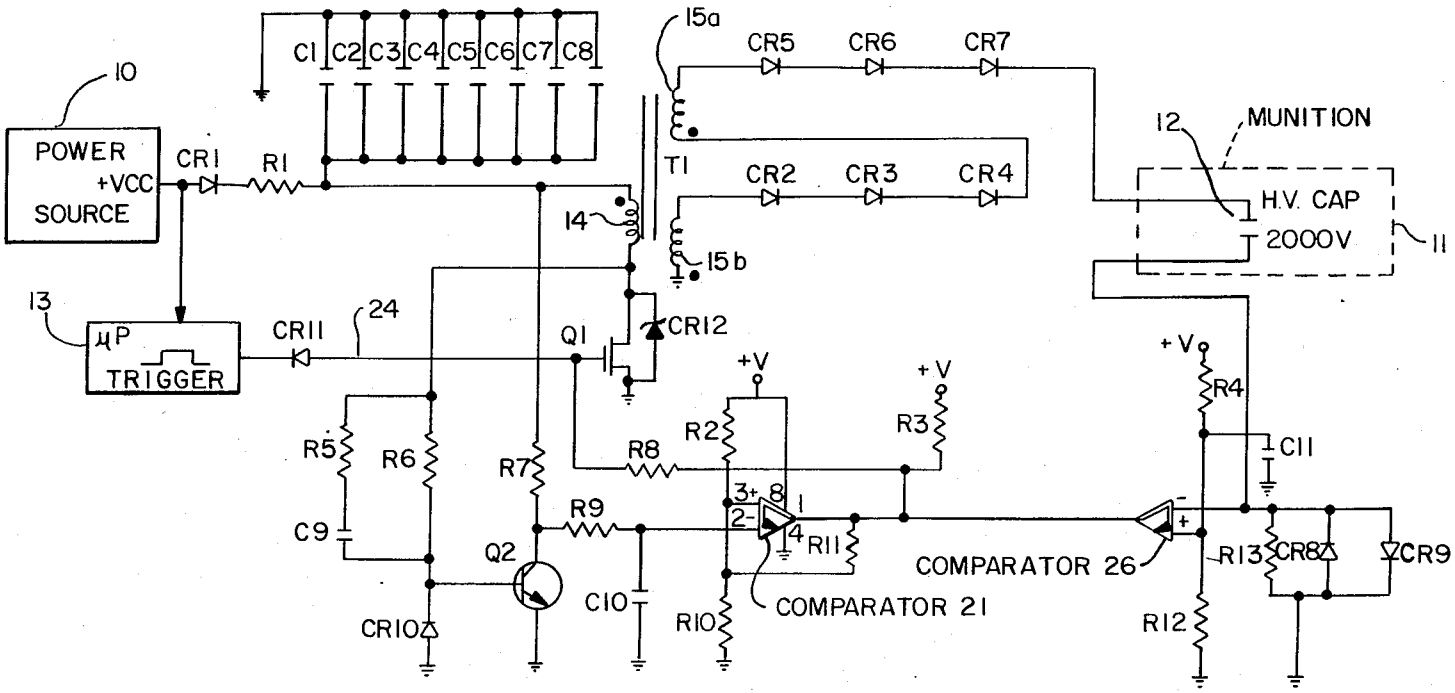
FIG. 1 is a circuit schematic embodying the present invention.
Figure 2:
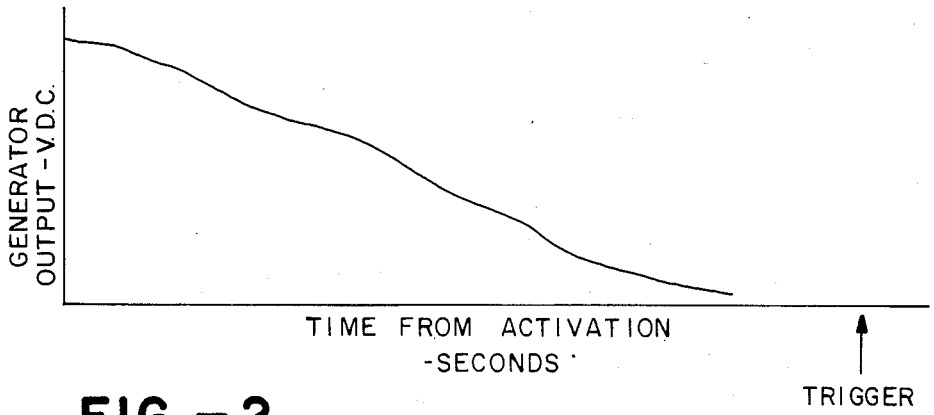
FIG. 2 is a characteristic curve useful in understanding the present invention.

Referring now to the circuit of FIG. 1, all of the electrical components shown and other components are within the casing or shell of a bomb or missle. Included in the unit is a power source which, for example, may be an air turbine or a thermal battery. In the case of an air turbine, it is activated by the dropping of the bomb and has a D.C. voltage output as illustrated in FIG. 2. A typical air turbine might have an initial voltage of 55 volts and then over a timing period of 2½ seconds decrease to a near zero voltage. This is because the dropped bomb may have attached to it a drag parachute. At any moment in time, the generator or air turbine power source will not produce enough energy to detonate the munition with which it is associated. Thus, energy must be stored over a period of time.

As illustrated in FIG. 1, a first energy storage means in the form of paralleled capacitors C-1 through C-8 are provided. These are connected to power source 10 by a diode CR1 and a resistor R1.

Several capacitors in parallel are shown for energy storage. However, a single capacitor might be substituted. A typical voltage stored across capacitor C1 through C8 is 28 volts. This is generally an insufficient voltage to directly initiate a detonation of the munition which is indicated by the dashed line 11. Instead, a high-voltage capacitor 12 is provided which is charged to a voltage of 2,000 volts. This is sufficient to initiate a firing unit in the munition 11 which, for example, might be an exploding foil initiator or exploding bridgewire.

To briefly summarize the safe-arm circuit, it includes a low-voltage capacitor bank C1 through C8 that holds a charge to be transferred to a high-voltage capacitor 12. Such transfer occurs at a time in the preferred embodiment determined by microprocessor 13 which provides a trigger pulse of, for example, 100 milliseconds. This activates the transfer circuitry (which is the remainder of FIG. 1) only at a time when it is safe. A typical procedure might be the sensing of the initiation of power generation on power source 10 by microprocessor 13, and then a time out of, for example, 5 seconds. And this trigger pulse would only occur after the time period of, for example, 2½ seconds necessary to charge the low-voltage capacitor bank C1-C8 (see FIG. 2). The charging of this capacitor bank has in effect integrated the area under the generator curve of FIG. 2; in other words, it is over a period of time of, for example, 2½ seconds in which the entire energy output of power source 10 is stored.

Referring now to the remainder of the circuitry of FIG. 1, capacitor bank C1–C8 is connected to a transinductance in the form of a transformer T1. It includes the low-voltge winding 14 and a split pair of high-voltage windings 15*a* and 15*b*. These are connected in series by diodes CR2, CR3 and CR4. Then the winding 15*a* is connected through the diodes CR5, CR6 and CR7 to high-voltage capacitor 12. Capacitor 12 is grounded via a current shunt, R13 and the back-to-back diodes CR8 and CR9.

Thus, from the foregoing it is apparent that the charge transfer path between the capacitor bank C1–C8 and high-voltage capacitor 12 is essentially composed only of inductor and capacitor components. Therefore, it is a very low-loss circuit with a high transfer efficiency of greater than 70%.

In order to minimize the size and weight of the transfer circuitry, which transfers energy from the low voltage to the high-voltage capacitor, it has been found that such transfer and conversion most ideally should take place in a multiplicity of steps. This allows the transinductance or transformer T1 to remain relatively small.

Figure 4:
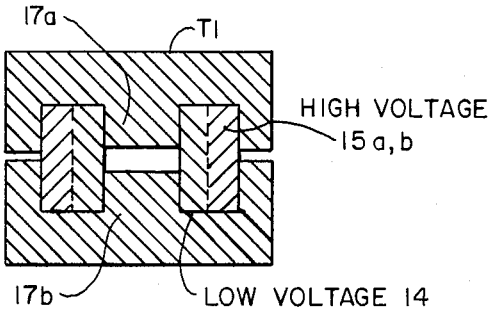
FIG. 4 is a cross-sectional view of an electrical component of FIG. 1.
Figure 5:
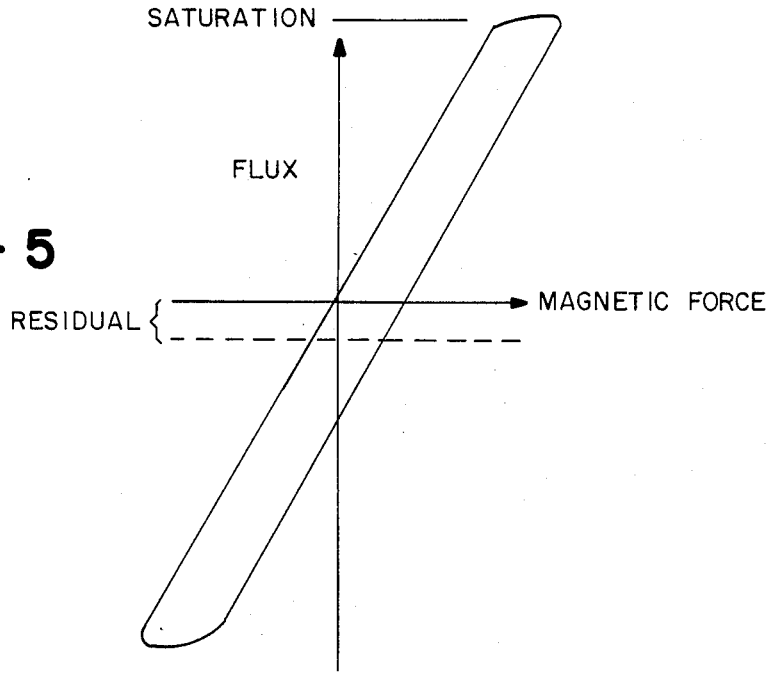
FIG. 5 is a diagram useful in understanding the operation of a component of FIG. 4.

Referring to FIG. 4 briefly, transformer T1 is illustrated and is in the form of a ferrite pot core. It is sold commercially under the trademark "Ferroxcube." The center poles 17*a* and 17*b* have a gap therebetween and have wrapped around them first the lower voltage winding 14 and then wrapped on top of that the high voltage windings 15*a* and 15*b*. The gap as illustrated in FIG. 5, stores magnetic energy and causes a tilted hysteresis loop (as opposed to one which is aligned with the vertical flux axis) so that one residual flux remains minimal. Thus, the transformer T1 can be cycled on and off very rapidly (for example, 1500 times over a period of 1/10th of a second).

Figure 3A:
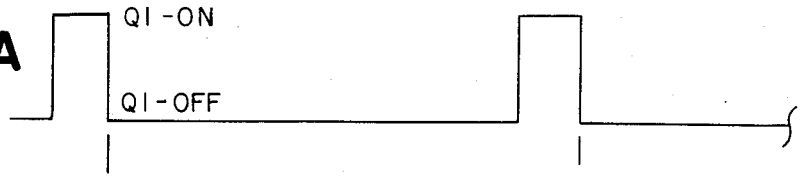
FIGS. 3A through 3F are timing diagrams useful in understanding the operation of the circuit of FIG. 1.
Figure 3B:
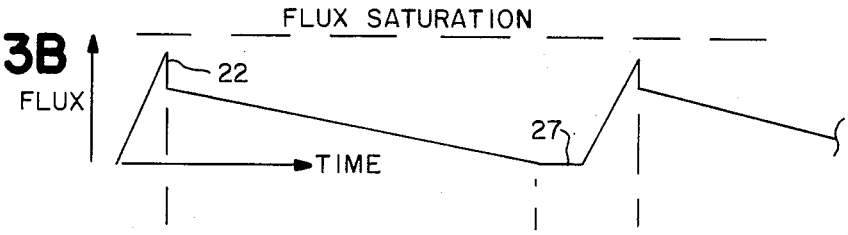

The timing circuit for controlling the transfer of energy from capacitor banks C1–C8 to high-voltage capacitor 12 includes the field effect transistor Q1 which, when on couples the capacitor bank C1–C8 to ground through the low-voltage coil 14. This is illustrated in FIG. 3A. As shown in FIG. 3B, the flux level in the core of transformer T1 builds up toward a flux saturation point. It is necessary to turn the switch Q1 off, before saturation occurs because after saturation, of course, the transformer T1 loses it back "emf" and thus would completely discharge the capacitors C1–C8. Switch Q1 is turned off at the appropriate time by a transistor Q2 and its associated timing circuit, resistor R7 and capacitor C10. Both are connected to the collector of Q2 (R9 has a relatively low resistance). Capacitor C10 is, of course, charged to a voltage which is proportional to the voltage of capacitor bank C1–C8. This voltage on C10 is sensed by a comparator 21, which has as its reference input the midpoint of resistors R2 and R10 which are connected to a positive reference voltage source.

Figure 3C:
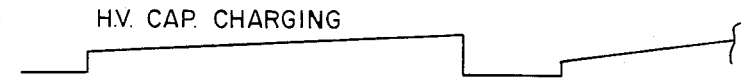
Figure 3D:
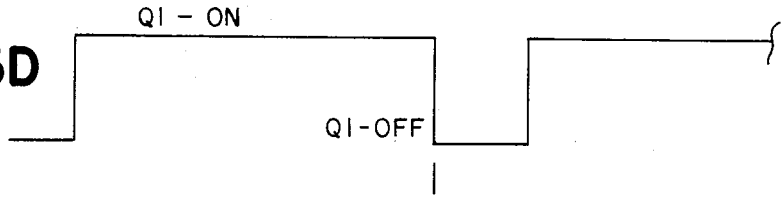
Figure 3E:
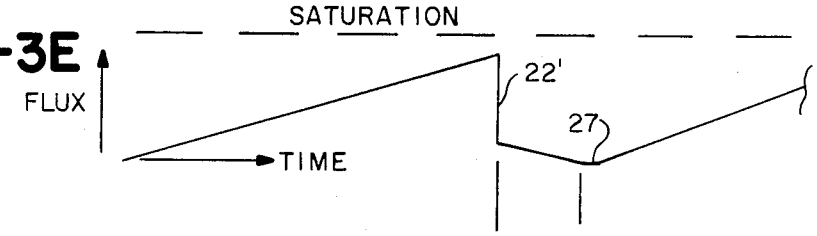
Figure 3F:
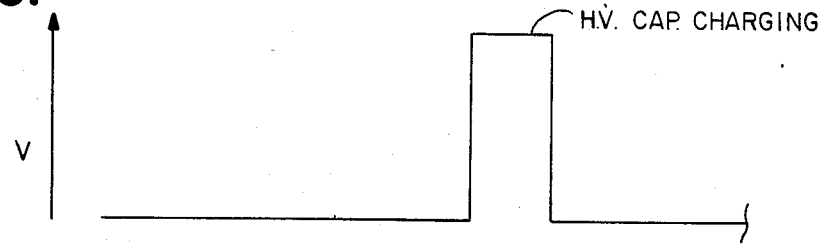

When capacitor C10 is charged to a predetermined amount, for example, 2 volts, the output of comparator 21 which is connected to switch Q1 through resistor R8, turns off switch Q1. When this occurs, as indicated in FIG. 3A, the magnetic field collapses at a rate as illustrated in Fig. 3B which is almost vertical, as shown by the segment 22. The voltage generated by this collapse of the energy stored in the magnetic field is clipped by the rectifying diodes CR2 through CR7 and stored in high-voltage capacitor 12, as indicated in FIG. 3C. The level of the voltage of Fig. 3C early in the transfer process is relatively low (for example, 10's of volts). But by opening and closing switch Q1 in a multiplicity of 1500 steps over a period of 1/10th of a second, the charge on capacitor 12 eventually arrives at 2,000 volts. However, since the voltage on capacitor bank C1–C8 during this time and its stored energy are being depleted, in order to achieve the same flux level and thus the necessary high-voltage, Q1 must be held on for longer and longer periods of time. In effect, those time periods are inversely proportional to the voltage level of capacitor bank C1–C8. Thus, at the onset of the charge transfer when, for example, 28 to 30 volts might still be on capacitor bank C1–C8, Q1 would be turned on by its associated timing circuit for a time period of for example, five-millionths of a second (see FIG. 3A). The end of such transfer sequence is illustrated in FIG. 3D, where Q1 is held on for a relatively long period of time. FIG. 3E illustrates the flux level rising to approach the flux saturation of the core of transformer T1; but this now requires a much longer period of time. And then, as illustrated in FIG. 3F, when switch Q1 turns off, a relatively high voltage approaching 2,000 volts is produced to charge the capacitor 12.

It should be emphasized that the time interval between the FIGS. 3A, 3B and 3C, and FIGS. 3D, 3E and 3F, is only 1/10th of a second. For example, this is because the charging of the capacitor bank C1–C8 has already consumed 2 to 3 seconds and the munition must be armed in a time period which is at least an order of magnitude less.

Now, referring to the details of the timing circuit for turning switch Q1 on and off. When switch Q1 turns on, transistor Q2 is turned off because there is no bias current flowing to resistor R6. In other words, Q1 grounds out this part of the circuit in its on condition. Thus, transistor Q2 turns off and the timing period begins as determined by R7 and C10. The timing period is the period illustrated in FIGS. 3B and 3E to allow the flux to approach saturation level. When this occurs, comparator 21 is activated to turn off Q1. Since Q1 no longer grounds the base of Q2, it is turned on by its pull-up resistor R6. The paralleled series circuit of R6 and capacitor C9 are for speed-up purposes. The diode CR10 connected to the switching input of transistor Q2 clips any negative going transients to protect the base junction of the transistor.

Resistor R9, which is of a relatively low resistance compared to R7, provides a discharge path for capacitor C10.

Finally, the trigger input of microprocessor 13 which initiates the charge transfer process, that is, line 24, includes the diode CR11 to isolate it from the timing circuitry.

Referring to comparator 26 of FIG. 1, this in essence senses the charging current of capacitor 12 to ensure that the flux level in transformer T1 is substantially at zero before the next sequence of operation occurs. If this were not the case, there would be an incremental increase in the flux level of the core causing eventual saturation. When this happens, in effect, the capacitor bank C1–C8 is totally discharged to defeat the object of the circuit.

Comparator 26 has as its reference input the series resistors R4 and R12, which are connected to a positive voltage source. The other input senses the current in capacitor 12 through the current shunt resistor R13, which is in parallel with back-to-back diodes CR8 and CR9. When the current multiplied by the resistance of R13 falls below the reference voltage applied to comparator 26, the comparator allows the switch Q1 to turn on via its pull-up resistor R3. Finally a hysteresis effect is provided by the feedback resistor R11 on comparator 21, to provide even an additional period of delay for the turn-on of switch Q1. This delay is shown by the horizontal portion 27 of FIGS. 3B and 3E.

In operation, it is apparent that the transfer circuitry is sensitive to the voltage level of the input capacitor bank C1–C8. Such voltage is, of course, sensed by the RC circuit consisting of resistor R7 and capacitor C10. At the onset of the transfer of charge from one capacitor bank to the other, switch Q1 stays on, for perhaps 5% of the total time; and at the end of the transfer period when the charge on capacitor bank C1–C8 is almost depleted, the switch Q1 is on 95% of the time period. Thus, in effect, "buckets" of energy are being shifted from the low-voltage capacitors to the energy stored in the magnetic air gap and thence to the high-voltage capacitor 12. But this is being accomplished with constant "volt-seconds" for each transfer. Thus, the effective step-up ratio of the transformer T1 is being varied. The actual primary to secondary turns ratio, which is 1 to 20, is determined only by the breakdown voltage of switch Q1. That is, assuming for example, a breakdown voltage of 100 volts, if high-voltage capacitor 12 is charged to 2,000 volts, then the ratio must be 1 to 20. Other than this constraint, the turns ratio is not critical since it is accommodated by the timing circuit. And the timing circuit in essence maintains the core of transformer T1 between zero flux and a flux level which approaches saturation but does not reach it.

An understanding of the invention is also aided by comparison of FIGS. 3B and 3E. Specifically in FIG. 3B the vertical collapse 22 of the flux is for a shorter period of time, compared to the collapse 22′ of FIG. 3E, since in the latter the higher voltage bias stored in high-voltage capacitor 12 must be overcome; in other words, the bias on the diodes CR2 through CR7. Thus, the charging voltage which must overcome a relatively low bias as illustrated by FIG. 3C continues to rise to FIG. 3F to match the opposing bias on the diodes.

The high-voltage windings 15*a* and 15*b* (FIG. 1) are split to cut down on the low frequency components of resonance and thus reduce ringing. Such ringing, otherwise, would reduce efficiency by reverse biasing switching transistor Q1.

Finally in accordance with a preferred embodiment of the invention, this transfer occurs in a multiplicity of steps because it reduces the size and weight of the required magnetic components. In other words, it is more efficient. Thus, an improved safe-arm system has been provided.

What is claimed:

1. A safe-arm system for an explosive munition comprising:

a low level power source incapable of directly initiating detonation of said munition;

first energy storage means connected to said power source and responsive thereto for storing energy over a period of time;

second energy storage means capable of initiating said detonation of said munition;

transinductance means for transferring and converting energy of a low voltage level from said first storage means to said second storage means at a high voltage level in response to a plurality of commands occurring after said period of time said commands connecting and disconnecting said first energy storage means to and from said transinductance means whereby said converting occurs in a multiplicity of steps, and means for providing said commands including timing circuit means for generating said commands for connecting said first energy storage means to said transinductance means for a time period inversely proportional to said voltage level of said first storage means.

2. A system as in claim 1, where said timing circuit means is responsive to depletion of said first energy storage means for causing said transinductance means to always approach a flux saturation level for each of said multiplicity of conversion steps.

3. A system as in claim 1, where said multiplicity of steps occur in a time interval which is at least an order of magnitude shorter than said period of time in which energy is stored in said first energy storage means.

4. A system as in claim 1, where said transinductance means is in the form of a transformer having a gapped core.

5. A system as in claim 1, where said transferring means is composed exclusively of inductor capacitor components whereby a low loss energy transfer is provided.

* * * * *